US008402783B2

(12) United States Patent
Kim et al.

(10) Patent No.: US 8,402,783 B2
(45) Date of Patent: Mar. 26, 2013

(54) ICE-MAKING DEVICE FOR REFRIGERATOR AND METHOD FOR CONTROLLING THE SAME

(75) Inventors: Young Jin Kim, Seoul (KR); Tae Hee Lee, Seoul (KR); Hong Hee Park, Seoul (KR); Ho Youn Lee, Seoul (KR); Joon Hwan Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 855 days.

(21) Appl. No.: 12/379,611

(22) Filed: Feb. 25, 2009

(65) Prior Publication Data

US 2009/0217678 A1 Sep. 3, 2009

(30) Foreign Application Priority Data

Feb. 28, 2008 (KR) ..... 10-2008-0018137

(51) Int. Cl.
*F25C 1/00* (2006.01)

(52) U.S. Cl. ..... 62/353; 62/139; 62/344; 62/345; 62/349; 62/351

(58) Field of Classification Search ..... 62/66, 71, 62/73, 77, 133, 135, 139, 340, 345, 346, 62/349, 351, 353, 354
See application file for complete search history.

(56) References Cited

U.S. PATENT DOCUMENTS 2,109,822 A * 3/1938 Eddy ..... 425/174.6
2,204,474 A * 6/1940 Cowling ..... 425/438
3,418,823 A * 12/1968 Salimbeni Vivai ..... 62/138
3,783,636 A * 1/1974 Archer ..... 62/353
4,923,494 A * 5/1990 Karlovits ..... 62/73
5,127,236 A * 7/1992 von Blanquet ..... 62/135
5,187,948 A 2/1993 Frohbieter
5,297,394 A * 3/1994 Frohbieter et al. ..... 62/135
5,425,243 A * 6/1995 Sanuki et al. ..... 62/138
6,357,720 B1 * 3/2002 Shapiro et al. ..... 249/119
6,647,739 B1 * 11/2003 Kim et al. ..... 62/352
6,688,130 B1 * 2/2004 Kim ..... 62/352
6,688,131 B1 * 2/2004 Kim et al. ..... 62/353
6,742,351 B2 * 6/2004 Kim et al. ..... 62/352
6,952,937 B2 * 10/2005 Choi et al. ..... 62/347
7,201,014 B2 * 4/2007 Hornung ..... 62/347
7,406,838 B2 * 8/2008 Wang ..... 62/344
2005/0115266 A1 * 6/2005 Lim et al. ..... 62/351
2005/0126202 A1 * 6/2005 Shoukyuu et al. ..... 62/351
2006/0201170 A1 * 9/2006 Cole ..... 62/135
(Continued)

FOREIGN PATENT DOCUMENTS

CN 1570525 A 1/2005
EP 0580 950 A1 2/1994

*Primary Examiner* — Cheryl J Tyler
*Assistant Examiner* — Paolo Gonzalez
(74) *Attorney, Agent, or Firm* — McKenna Long & Aldridge LLP

(57) ABSTRACT

An ice-making device for a refrigerator, which is designed to separate ice through a simple process is provided. The ice-making device for a refrigerator includes an ice tray defining an ice-making space, an ice core member that is partly received in the ice-making space to make ice at an end thereof, a driving unit moving and rotating at least one of the ice tray and the ice core member, and a power transmission unit for transferring power from the driving unit to the ice core member. The ice on the ice core member starts being separated in a state where the ice is spaced apart from an outer surface of the ice tray.

9 Claims, 11 Drawing Sheets

U.S. PATENT DOCUMENTS

2007/0130982 A1* 6/2007 Wang ..... 62/344
2007/0137241 A1* 6/2007 Lee et al. ..... 62/340
2008/0155999 A1* 7/2008 Shin et al. ..... 62/73
2008/0156000 A1* 7/2008 Shin et al. ..... 62/73
2008/0156001 A1* 7/2008 Lee et al. ..... 62/74
2008/0156025 A1* 7/2008 Shin et al. ..... 62/349
2009/0049858 A1* 2/2009 Lee et al. ..... 62/349
2009/0217692 A1* 9/2009 Kim et al. ..... 62/346
2010/0205995 A1* 8/2010 Ducharme et al. ..... 62/345
2010/0205996 A1* 8/2010 Ducharme et al. ..... 62/351

* cited by examiner

ICE-MAKING DEVICE FOR REFRIGERATOR AND METHOD FOR CONTROLLING THE SAME

CROSS-REFERENCE TO RELATED APPLICATIONS

The present application claims priority under 35 U.S.C. 119 and 35 U.S.C. 365 to Korean Patent Application No. 10-2008-0018137 (filed on Feb. 28, 2008), which is hereby incorporated by reference in its entirety.

BACKGROUND

The present disclosure relates to an ice-making device for a refrigerator and a method for controlling the same.

Generally, a refrigerator is used to store food or other things at a low temperature. The refrigerator has a plurality of storage chambers for storing the food. Each of the storage chambers has an opened side to take food in and out.

Recently, a refrigerator having a dispenser for dispensing ice and water has been developed. A water tank for storing water that will be supplied is connected to the dispenser.

An ice-making device for making ice using water supplied from the water tank is provided in the refrigerator. The ice-making device may be installed in a main body of the refrigerator or a door of the refrigerator.

When the ice-making device is provided at a chilling chamber, the ice-making device is formed in a thermal insulation structure to provide a low temperature environment. A passage is formed through side surfaces of the ice-making device and the refrigerator through which cool air of a freezing chamber can be introduced and discharged into and from the ice-making device.

An ice tray to which the water is supplied and frozen is provided in the ice-making device. The cool air is then supplied when the ice tray is filled with water to freeze the water into the ice.

In a typical ice-making device, a heater is provided at a side of the ice tray to separate the ice from the ice tray. In this case, a structure for directing the ice separated from the ice tray to an ice bank is complicated.

In addition, when the ice separated from the ice tray falls down to the ice bank, the ice may interfere with a part of the ice-making device and thus it may not be effectively dispensed.

SUMMARY

Embodiments provide an ice-making device for a refrigerator, which is designed to effectively separate ice through a simple operation.

Embodiments also provide an ice-making device for a refrigerator, which is designed to effectively dispense ice by effectively moving and rotating a freezing core or an ice tray.

Embodiments also provide an ice-making device for a refrigerator, which is designed such that ice separated from a freezing core and falling down does not interfere with an ice tray.

In one embodiment, an ice-making device for a refrigerator, including: an ice tray defining an ice-making space; an ice core member that is at least partially received in the ice-making space to form ice at an end thereof; a drive unit adapted to move at least one of the ice tray and the ice core member in a vertical and rotational direction; and a power transmission unit adapted to transfer power from the driving unit to the ice core member and to control the vertical and rotational movement thereof, wherein the ice formed on the ice core member is separated from the ice core member when the ice is positioned spaced apart from the ice tray so that the ice may fall downward without interference with the ice tray.

In another embodiment, an ice-making device for a refrigerator, including: a driving unit generating driving force; an ice tray provided at a side of the driving unit and defining an ice-making space; an ice core member that is partly received in the ice-making space and is capable of moving; a heat transferring fin coupled to the ice core member; and a guide unit adapted to guide movement of the ice core member and heat transferring fin and provided with a seating portion on which the heat transferring fin is seated, wherein ice is separated from the ice core member as the ice core member moves vertically above the seating portion and rotates toward an outer side of the ice tray.

In still another embodiment, an ice-making device for a refrigerator, including: an ice tray defining an ice-making space; a freezing core that is partly received in the ice-making space, and is capable of vertical movement and subsequently rotating; at least one heat transferring fin that is provided around the freezing core to effectively transfer heat to the freezing core; a driving unit that generates a driving force that moves and rotates the freezing core; and a power transmission unit transferring power from the driving unit to the freezing core, wherein a clearance distance is defined between a movement path of ice formed at the freezing core and an upper end of the ice tray to allow the ice to fall down to an ice bank without interference from a side of the ice tray.

In still yet another embodiment, a method for controlling an ice-making device for a refrigerator, including: receiving a freezing core in an upper portion of an ice tray to make ice on an end the freezing core; separating the ice from the ice tray; moving the freezing core above the ice tray; and rotating the freezing core by a predetermined rotating angle such that an ice separation path is spaced apart from the ice tray to prevent interference between separated ice and the ice tray.

In still further yet another embodiment, a method for controlling an ice-making device for a refrigerator, including: receiving a freezing core in an upper portion of an ice tray to form ice at an end the freezing core; separating the ice from the ice tray; moving the ice tray downward; and rotating the ice tray by a predetermined rotational angle to provide an ice separation path that is spaced apart from the ice tray.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
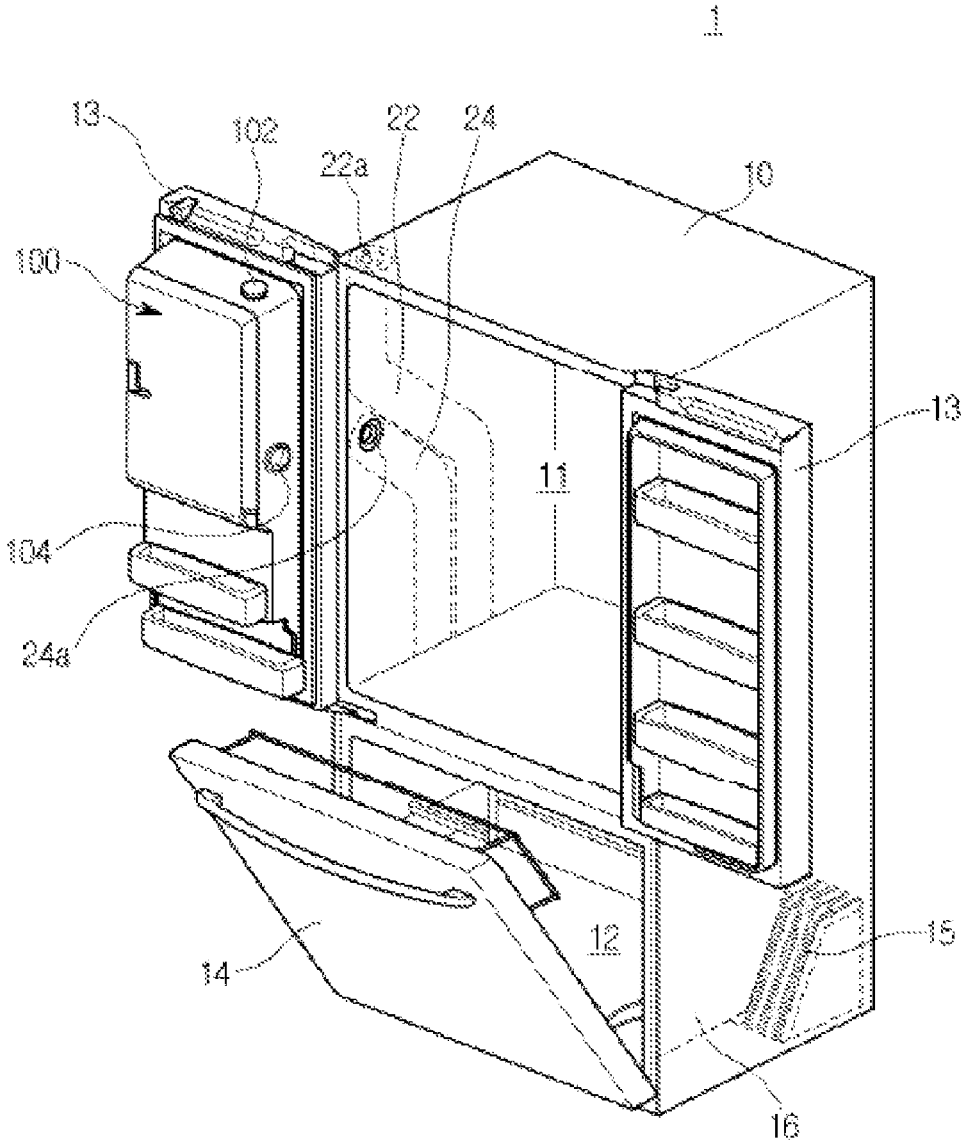
FIG. 1 is a perspective view of a refrigerator with an ice-making device according to a first embodiment.

FIG. 1 is a perspective view of a refrigerator with an ice-making device according to a first embodiment.

Referring to FIG. 1, a refrigerator 1 includes a main body 10 having a chilling chamber 11 and a freezing chamber 12, a chilling door 13 that is pivotally coupled to a front portion of the main body 10 to selectively open and close the chilling chamber 11, and a freezing door 14 that is provided on a lower-front portion of the main body 10 to selectively open and close the freezing chamber 12. Here, the chilling chamber 11 is defined at an upper portion of the main body 10 and the freezing chamber 12 is defined at a lower portion of the main body 10.

As illustrated in FIG. 1, and described in the exemplary embodiment, a bottom freezer type refrigerator is disclosed, where the freezing chamber is defined under the chilling chamber. However, the present disclosure is not limited to this embodiment. For example, the present disclosure may be applied to not only a top mount type refrigerator where the freezing chamber is defined above the chilling chamber but also a side-by-side type refrigerator where the freezing and chilling chambers are defined at right and left sides, respectively.

In more detail, the chilling door 13 may be divided into two sections that are respectively coupled to both sides of the main body 10 by hinges (not shown). The freezing door 14 is coupled to a lower end of the main body 10 by a hinge (not shown) and is designed to be withdrawn in the form of a drawer.

In addition, an evaporator 15 for generating cool air that will be supplied into the main body 10 may be provided at a lower-rear portion of the main body 10. A storage container 16 for storing foodstuffs may be provided in the freezing chamber 12 to be capable of being withdrawn.

An ice-making device 100 for making ice and a plurality of baskets for receiving a variety of foodstuffs may be provided on an inner surface of the chilling door 13.

The ice-making device 100 is provided with a cool air inlet 102 through which cool air may be supplied to the freezing chamber 12, and a cool air outlet 104, through which the cool air circulating in the ice-making device 100 may be discharged toward the evaporator 15.

A cool air supply duct 22, for supplying the cool air to the cool air inlet 102, and a discharge duct 24, to which the cool air is discharged from the cool air outlet 104, are provided at a side of the main body 10.

A first end of each of the cool air supply and discharge ducts 22 and 24 are in fluid communication with the freezing chamber 12. A portion of the cool air generated by the evaporator 15 may be supplied to the ice-making device 100 through the cool air supply duct 22. The cool air circulating in the ice-making device 100 may be discharged into the freezing chamber 12 through the cool air discharge duct 24.

Duct supply and discharge holes 22*a* and 24*a* are respectively formed on second ends of the cool air supply and discharge ducts 22 and 24. The duct supply and discharge holes 22*a* and 24*a*, are in fluid communication with the cool air inlet and outlet 102 and 104, respectively.

Here, the duct supply and discharge holes 22*a* and 24*a* are disposed on an inner surface of the main body 10 to correspond to the cool air inlet and outlet 102 and 104 such that, when the chilling door 13 is closed, the duct supply and discharge holes 22*a* and 24*a* communicate with the cool air inlet and outlet 102 and 104, respectively.

Figure 2:
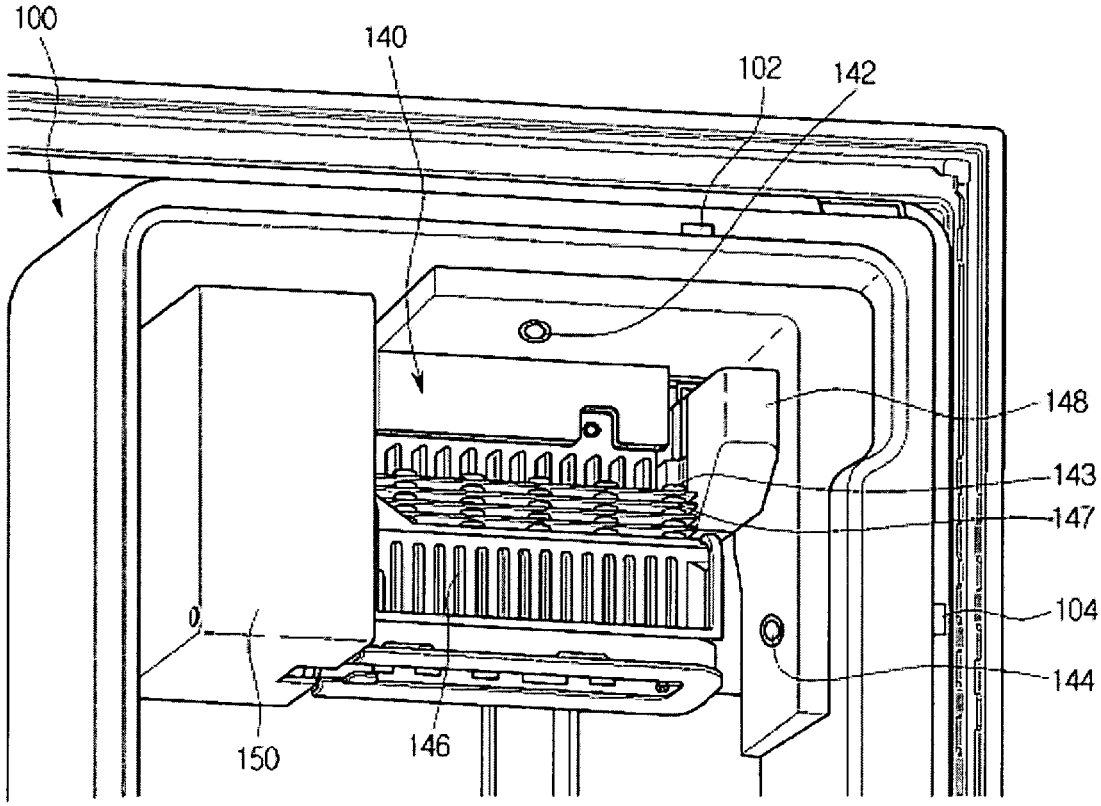
FIG. 2 is a perspective view illustrating an internal structure of the ice-making device of FIG. 1.

FIG. 2 is a perspective view illustrating an internal structure of the ice-making device of FIG. 1. Referring to FIG. 2, the ice-making device 100, which is designed to make ice and allow a user to use the ice, is provided at the inner surface of the chilling door 12.

In more detail, the ice-making device 100 includes an ice-making unit 140 for making the ice using water supplied from an external force, an ice bank (not shown in FIG. 2) that is disposed under the ice-making unit 140 to store the ice made by the ice-making unit 140, a dispenser (not shown in FIG. 2) for dispensing the ice stored in the ice bank.

The following will describe the structure of the ice-making unit 140 in more detail. The ice-making unit 140 includes a water supply unit 148 for supplying water from an external source to an ice tray 146. The water that is supplied to the ice tray 146 is then frozen. One or more freezing cores 143 may be provided for freezing the water supplied into the ice tray 146, and one or more heat transferring fins 147 may be provided for effectively transferring heat from the freezing cores 143. In more detail, the freezing cores 143 are provided above the ice tray 146. In order to effectively utilize space, the freezing cores 143 may be arranged along at least two lines so that a plurality of ice cubes can be made.

The freezing cores 143 may be formed in a bar shape extending in a vertical direction. Each of the freezing cores 143 may be a least partially received in an ice-making space of the ice tray.

Figure 3:
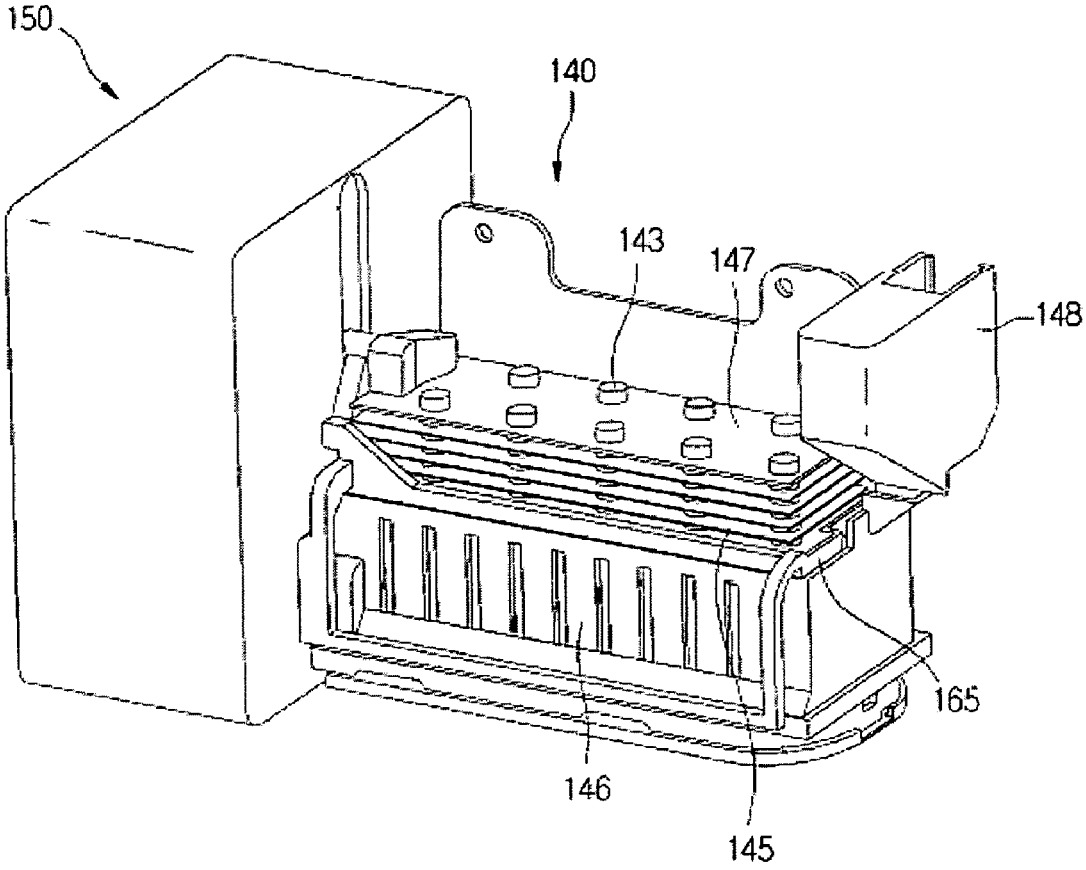
FIG. 3 is a perspective view of the ice-making device of FIG. 1.

As illustrated in FIG. 3, the heat transferring fins 147 may be formed in a plate-like shape and inserted around the freezing cores 143. That is, each of the heat transferring fins 147 may be provided with a plurality of holes having a substantially identical diameter to each of the freezing cores 143. The freezing cores 143 are then inserted in the holes of the heat transferring fins 147. The heat transferring fins 147 are spaced apart from each other in a length-wise direction of the freezing cores 143.

As described above, as the plurality of layers of heat transferring fins 147 are disposed to contact an outer surface of each of the freezing cores 143. This contact allows the heat transfer from the cool air to be more effective.

Further, the freezing cores 143 and the heat transferring fins 147 are provided above the ice tray 146 so that they may be moved upward. More specifically, the freezing cores 143 and the heat transferring fins 147 are adapted to be rotated and moved upward.

Further, the ice-making unit 140 further includes a control box 150 that enables the freezing cores 143 and the heat transferring fins 147 to move and rotate. The control box 150 may include a motor for providing driving force to the freezing cores 143 and the heat transferring fins 147 and a cam unit for transferring the driving force of the motor. The cam unit will be described in more detail below.

Meanwhile, the ice tray 146 may be designed to be connected to the control box 150 and rotate when the freezing cores 143 and the heat transferring fins 147 remain stationary. The structure of the control box 150 and the operation of the freezing cores 143 or the ice tray 146 will be described in more detail with reference to the accompanying drawings.

As illustrated in FIG. 2, the cool air inlet 102 is provided above the ice-making device 100. The cool air inlet 102 is designed to allow cool air to flow from the freezing chamber 15 to the ice-making device 100 when the chilling door 13 is closed. As previously described, the cool air inlet 102 may be connected to the duct supply hole 22*a*.

As described above, a cool air passage 22 (FIG. 1) supplying cool air flow to the cool air inlet 102 may be provided under the cool air inlet 102. A cool air supply 142 through which the cool air is introduced into the ice-making unit 140 may be formed at an upper portion of the ice making device 100.

A cool air exhaust 144 through which the cool air that has passed through the freezing cores 143 and the ice tray 146 may be discharged from the ice-making unit 140, is formed at a side thereof. The cool air exhaust 144 communicates with the cool air outlet 104 formed on a side surface of the ice-making device 100. Accordingly, the cool air discharged through the cool air exhaust 144 is directed through cool air outlet 104 into discharge duct 24, and back to the freezing chamber 12.

As described above, the cool air may be supplied from an upper portion to a lower portion of the ice-making unit 140, and discharged toward a side of thereof. Therefore, the cool air is uniformly supplied to the freezing cores 143 enabling uniform freezing of the water.

Figure 4:
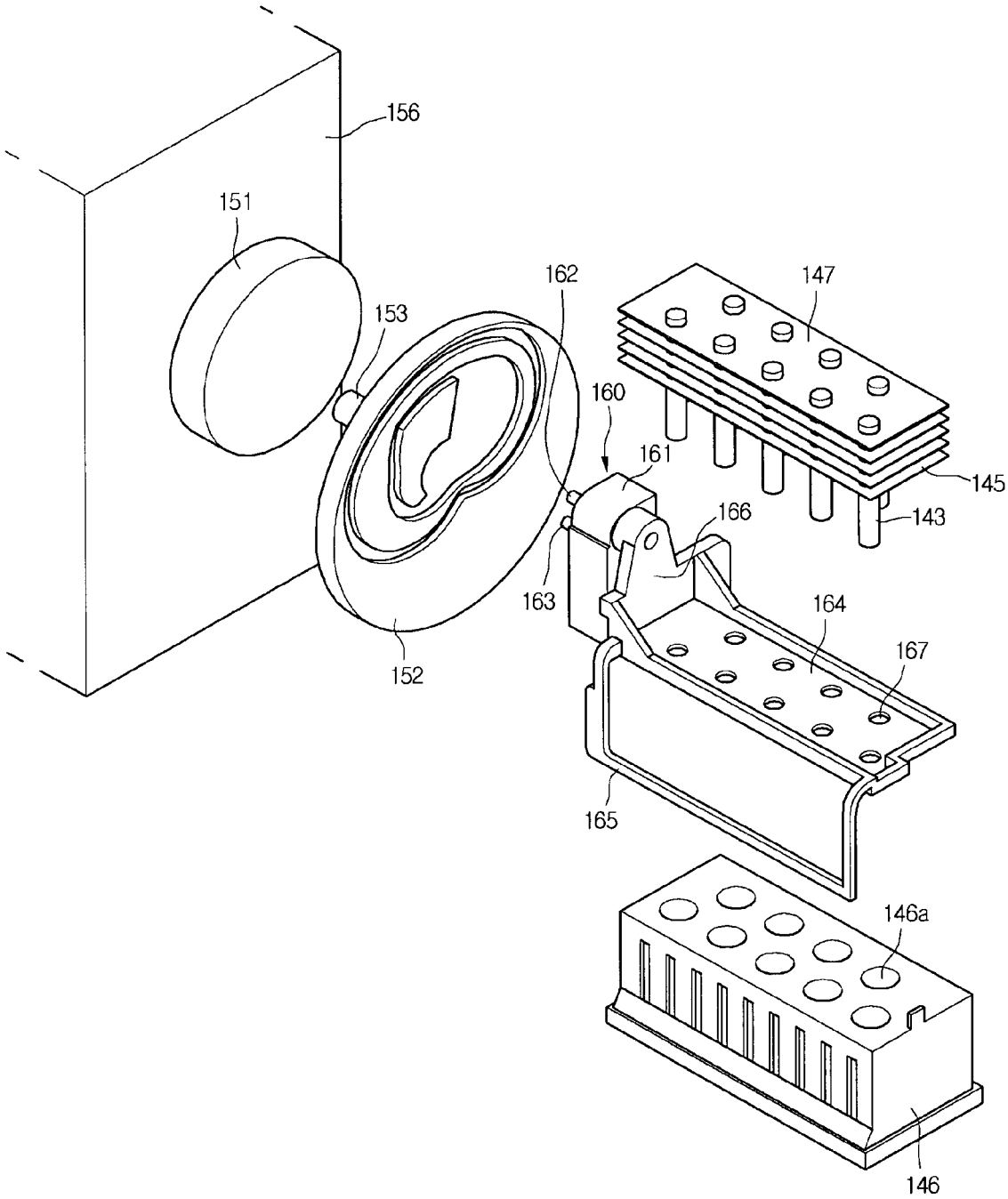
FIG. 4 is an exploded perspective view of the ice-making device of FIG. 3.

Referring to FIGS. 3 and 4, the ice-making unit 140 of the exemplary embodiment includes the water supply unit 148 for storing water introduced from an external source, and the ice tray 146 into which the water is supplied from the water supply unit 148 and frozen into ice. The freezing cores 143 may also be provided above the ice tray 146 to define an ice core by supplying cool air to the water stored in the ice tray 146. Finally, the heat transferring fins 147 may be included for enhancing the heat transfer of the freezing cores 143.

In more detail, a plurality of ice-making spaces 146*a* are provided at an inside of the ice tray 146, and are adapted to receive and store water from the water supply unit 148. A first end of each of the freezing cores 143 (i.e., ice core generating members) are received in the respective ice-making spaces 146*a*.

Accordingly, the number of the ice-making spaces 146*a* correlate to the number of freezing cores 143. The water supplied to the ice-making spaces 146*a* may then be frozen by contacting the freezing cores 143.

A lower portion of the ice-making spaces 146*a* may be rounded and thus a lower portion of each of ice cubes made in the respective ice-making spaces 146*a* may then be rounded. Hence, the ice cubes have an improved outer appearance, satisfying consumers.

In addition, the heat transferring fins 147 are spaced apart from each other along the length direction of the freezing cores 143. The heat transferring fins 147 are provided with a plurality of holes in which the freezing cores 143 are inserted. Here, the number of the insertion holes may be the same as the number of the freezing cores 143.

Further, an ice separation heater 145 may be provided under the heat transferring fins 147 to separate the ice cubes made by the freezing cores 143. A lowermost heat transferring fin may function as the ice separation heater 145.

That is, all the heat transferring fins 147, except for the lowermost heat transferring fin, function to freeze the water. The lowermost heat transferring fin functions as the ice separation heater 145 for separating the ice cubes. In order to accomplish this function, the ice separation heater 145 may be separately controlled by a controller (not shown).

Meanwhile, another heater (not shown) may be provided at a side of the ice making spaces 146*a* of the ice tray 146 to effectively separate the ice cubes from the ice tray 146.

In addition, a temperature sensor (not shown) may be provided at a side of the ice tray 146 to detect a surface temperature of the ice tray 146. The operation of the heater of the ice tray 146 may be controlled by the temperature sensor.

That is, when the heater of the ice tray 146 operates during the ice separation process, the surface temperature of the ice tray 146 increases over a limit, which the temperature sensor can detect. The heater of the ice tray 146 is turned off in accordance with the temperature value detected by the temperature sensor.

In addition, provided between the ice tray 146 and the freezing cores 143 is a guide unit 160 for guiding the vertical and rotational motions of the freezing cores 143. That is, the freezing cores 143 move and rotate in accordance with the guide unit 160.

In more detail, the guide unit 160 includes a seating portion 164 on which the heat transferring fins 147 and the freezing cores 143 are seated. The seating portion 164 is shaped and sized to correspond to the lowermost heat transferring fin (i.e., the ice separation heater 145). Further, disposed between the seating portion 164 and the ice separation heater 145 is a connecting member (not shown) connecting the seating portion 164 to the ice separation heater 145.

When the seating portion 164 is connected to the ice separation heater 145, the heat transferring fins 147 and the freezing cores 143 move and rotate as one with the guide unit 160.

The seating portion 164 may be provided with insertion holes 167 in which the freezing cores 143 are inserted. Further, the insertion holes 167 of the seating portion 164 may be formed to correspond to the insertion holes of the heat transferring fins 147.

An extending portion 166 extending from the seating portion 164 in a vertical direction may be formed at a side of the seating portion 164.

The guide unit 160 includes first and second shafts 162 and 163 adapted to guide the movement or rotation of the guide unit 160. The first and second shafts 162 and 163 are provided at a side of the extending portion 166 and a moving member 161. The moving number 161 receives the shafts 162 and 163.

The moving member 161 is connected to and moves integrally with the extending portion 166.

Here, the shafts 162 and 163 may protrude from a side of the moving member 161 toward an external side. The shafts 162 and 163 are spaced apart from each other and arranged along a length of the moving member 161.

A driving motor 151 is provided to import a driving force for moving and rotating the guide unit 160. A cam unit 152 is adapted to transfer the driving force generated by the driving motor 151 to the guide unit. The cam unit 152 thus functions as a power transmission unit.

A motor shaft 153 that is driven by the rotational force of the driving motor 151 is provided on a side thereof. The motor shaft 153 is connected to and rotates the cam unit 152 in a predetermined direction.

The cam unit 152, shafts 162 and 163, and moving member 161 transfers the power of the motor 151 to the freezing cores 143. Therefore, the shafts 162 and 163 and the moving member 161 function to not only transfer power from the motor but also to guide rotation of the freezing cores 143.

As illustrated in FIG. 3, the extending portion 166, shafts 162 and 163, moving member 161, cam unit 152, and driving motor 151 are disposed in a case 156 defining an exterior of the control box 150. Therefore, the case 156 of the control box 150 defines a predetermined space inside thereof. The case may be separately provided.

The guide unit 160 is provided with a tilt preventing portion 165 for preventing the seating portion 164 from tilting in a predetermined direction when the guide unit 160 moves and rotates. The tilt preventing portion 165 is bent downwardly and extends from a side of the seating portion 164. A first side of the drooping preventing portion 165 is disposed adjacent to a side surface of the case 156.

In more detail, the seating portion 164 has a first end that is supported on the moving member 161 by the extending portion 166 and a second end that is free. In this case, the second end of the seating portion 164 does not tilt downward when the guide unit 160 moves and rotates. However, a first side of the tilt preventing portion 165 extends downward to be substantially adjacent and parallel to a side of the ice tray 146. Therefore, the tilt preventing portion 165 and a side of the ice tray 146 interact with each other, thereby preventing and undesirable titling of the seating portion 164.

Figure 5:
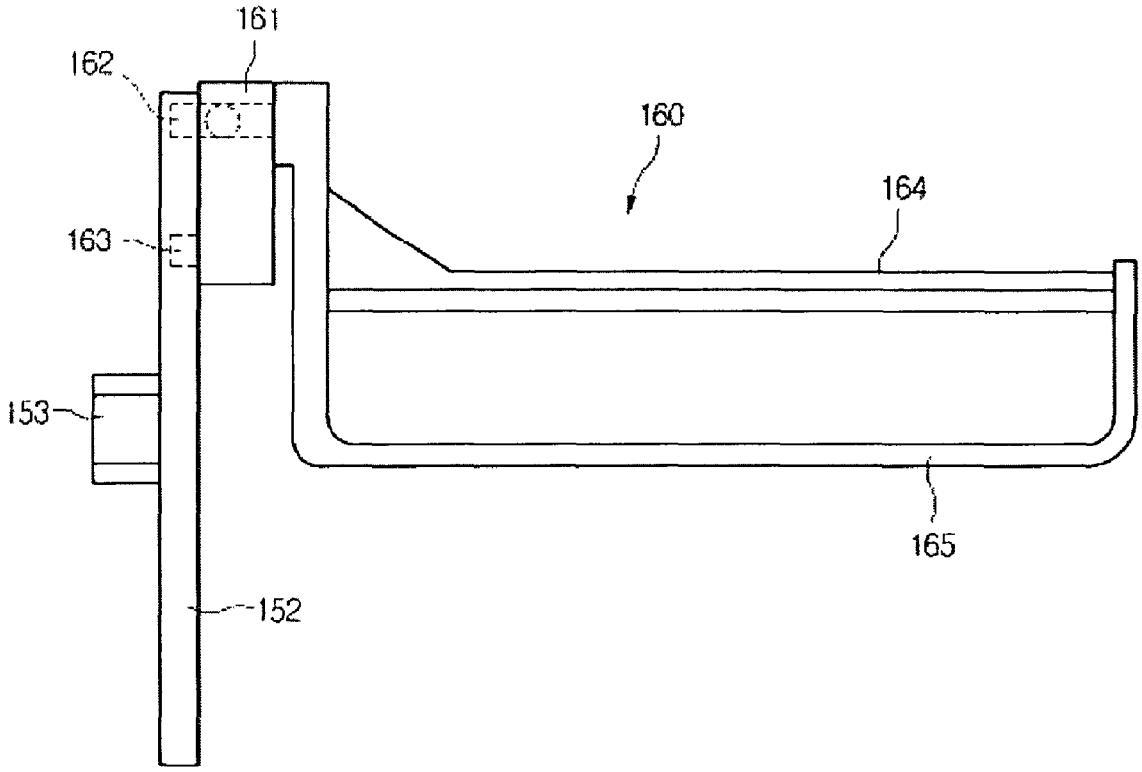
FIG. 5 is a side view of a power transmission mechanism of the ice-making device of FIG. 3.
Figure 6:
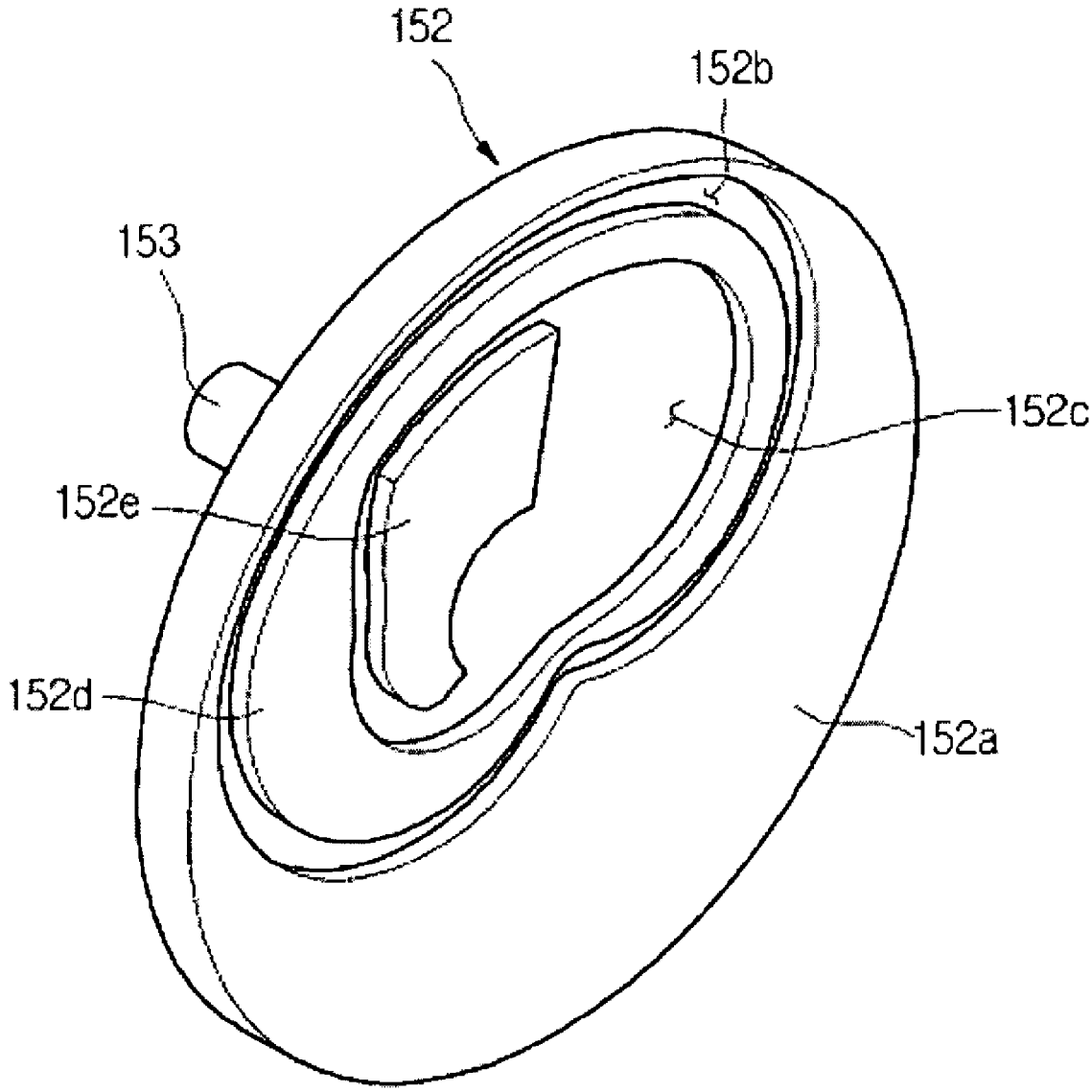
FIG. 6 is a perspective view of a cam unit according to an embodiment.

FIG. 5 is a side view of a power transmission mechanism of the ice-making device of FIG. 3, and FIG. 6 is a perspective view of a cam unit according to an embodiment.

The following will describe a power transmission mechanism for moving and rotating the guide unit 160 according to the first embodiment with reference to FIGS. 5 and 6.

The driving motor 151 and the cam unit 152 are interconnected by the motor shaft 153. Therefore, when the driving motor 151 operates, the motor shaft 153 and the cam unit 152 rotate in an identical direction. Additionally, the first and second shafts 162 and 163 are connected to the cam unit 152.

The cam unit 152 includes a main body 152*a* formed as a substantially circular plate. An outer groove 152*b*, is formed on the main body 152*a* and is adapted to receive the first shaft 162. An inner groove 152*c* is disposed central to the outer groove 152 and is adapted to receive the second shaft 163. The grooves 152*b* and 152*c* may be referred to as guide grooves for guiding the movement of the first and second shafts 162 and 163.

In more detail, the outer and inner grooves 152*b* and 152*c* are formed by concave portions having different rotational radii with respect to a rotational center of the cam unit 152. The first and second grooves 152*b* and 152*c* are formed in a roughly heart shape.

Formed between the outer and inner grooves 152*b* and 152*c* is a first protrusion 152*d*. First protrusion 152*d*. First protrusion 152*d* defines a boundary between the outer and inner grooves 152*b* and 152*c* and is adapted to guide the movement of the first shaft 162. Formed in the inner groove 152*c* is a second protrusion 152*e* for guiding the movement of the second shaft 163.

The first and second protrusions 152*d* and 152*e* may be elevated to a same height as a top surface of the main body 152*a*. That is, the height of the first and second protrusions 152*d* and 152*e* is substantially equivalent to the depots of the outer and inner grooves 152*b* and 152*c*.

The first and second protrusions 152*d* and 152*e* have different shapes. Therefore, the first and second shafts 162 and 163 move in different directional patterns while moving along the inner and outer grooves 152*b* and 152*c*, respectively.

Figure 7A:
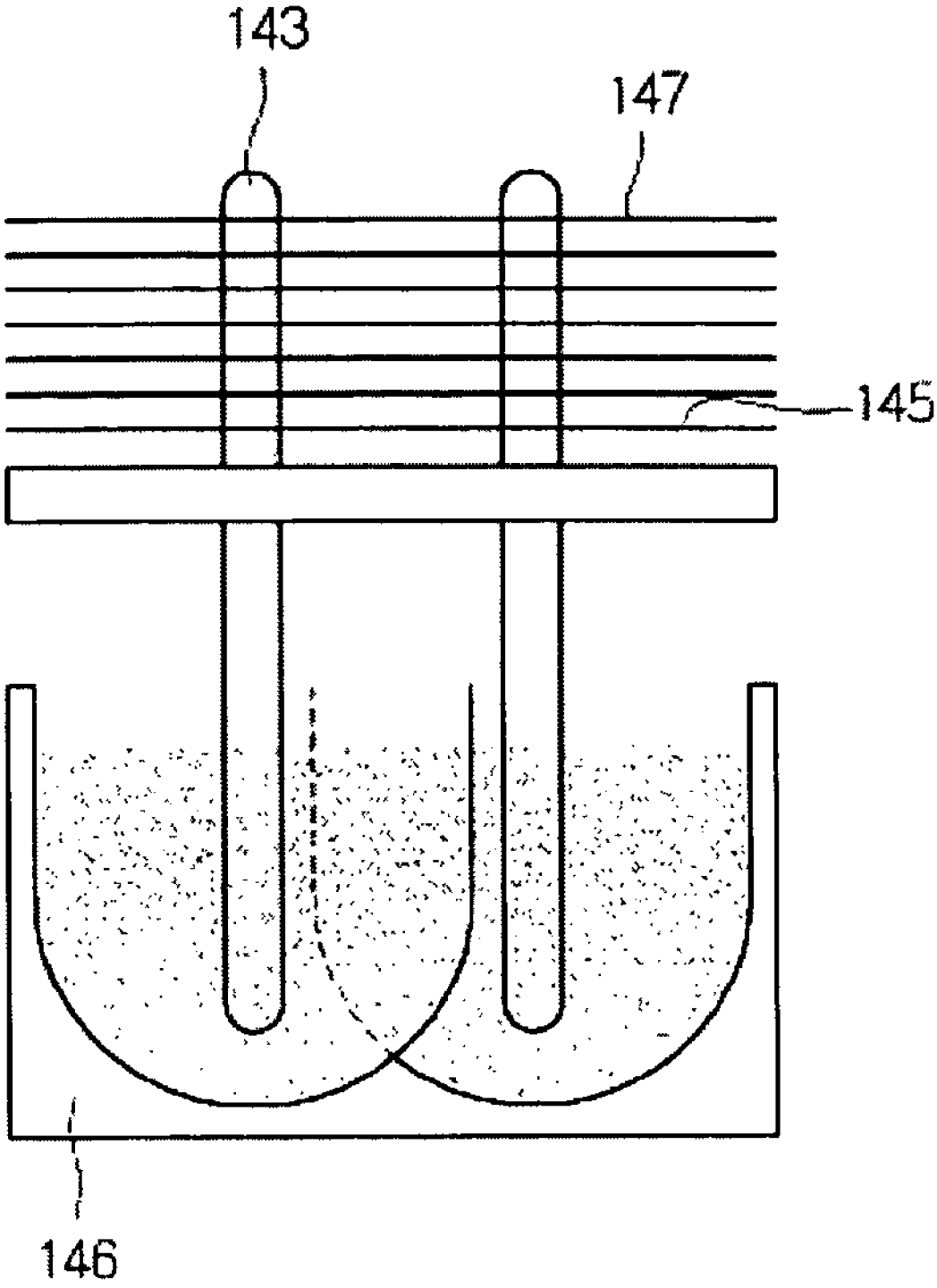
FIGS. 7A, 7B, and 7C are schematic views illustrating rotation of an ice core making structure according to an embodiment of the present invention.
Figure 7B:
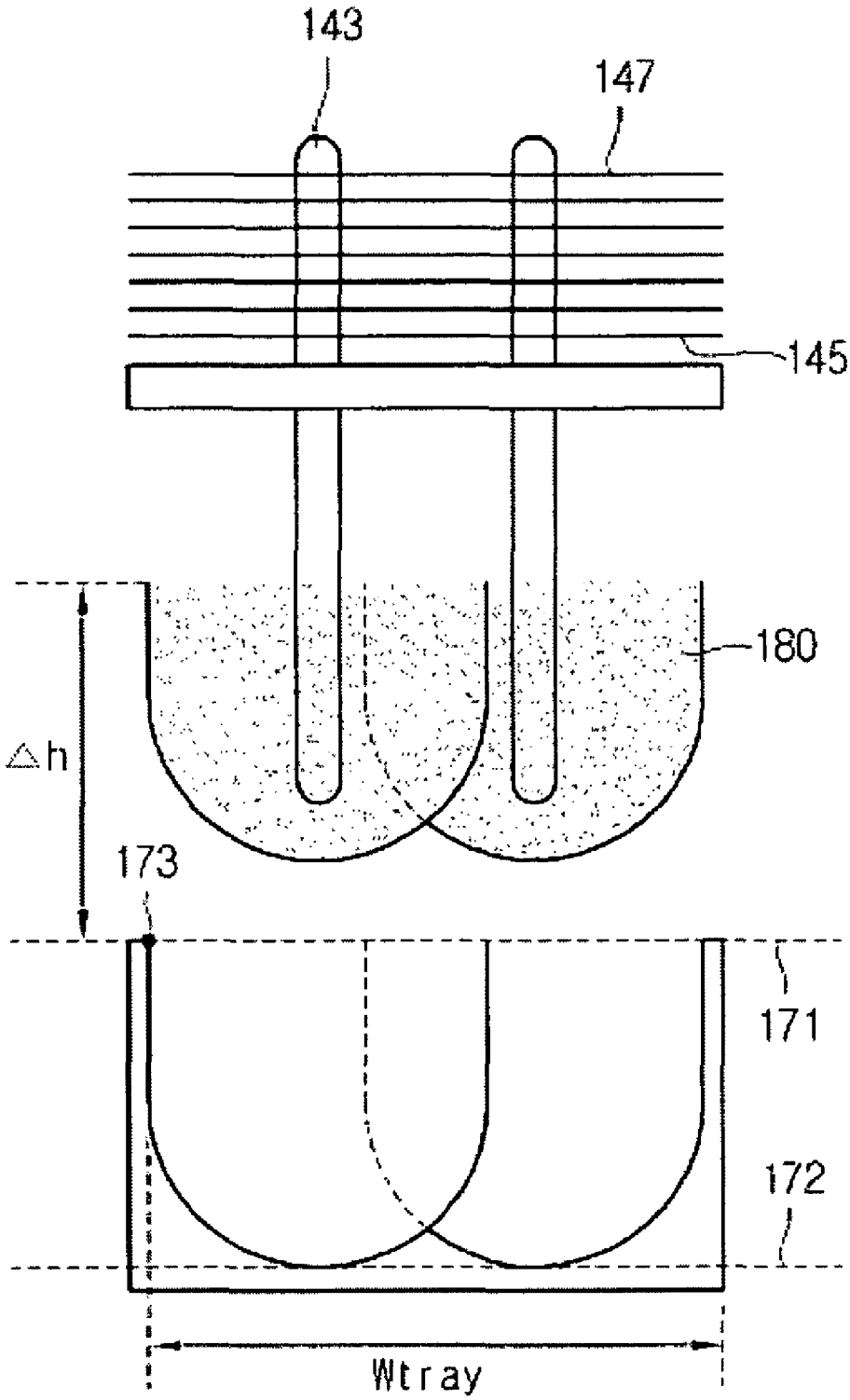
Figure 7C:
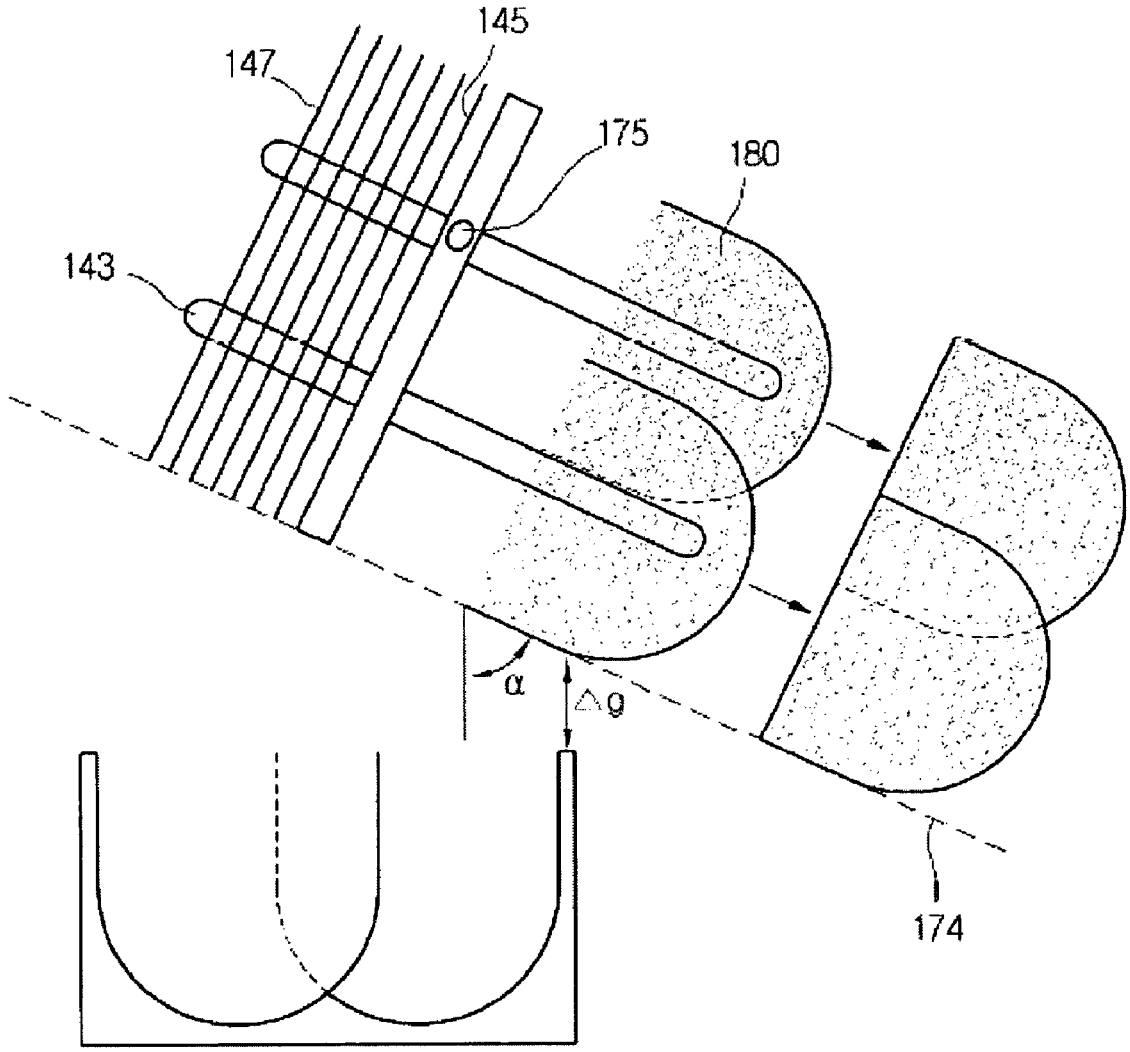
Figure 8:
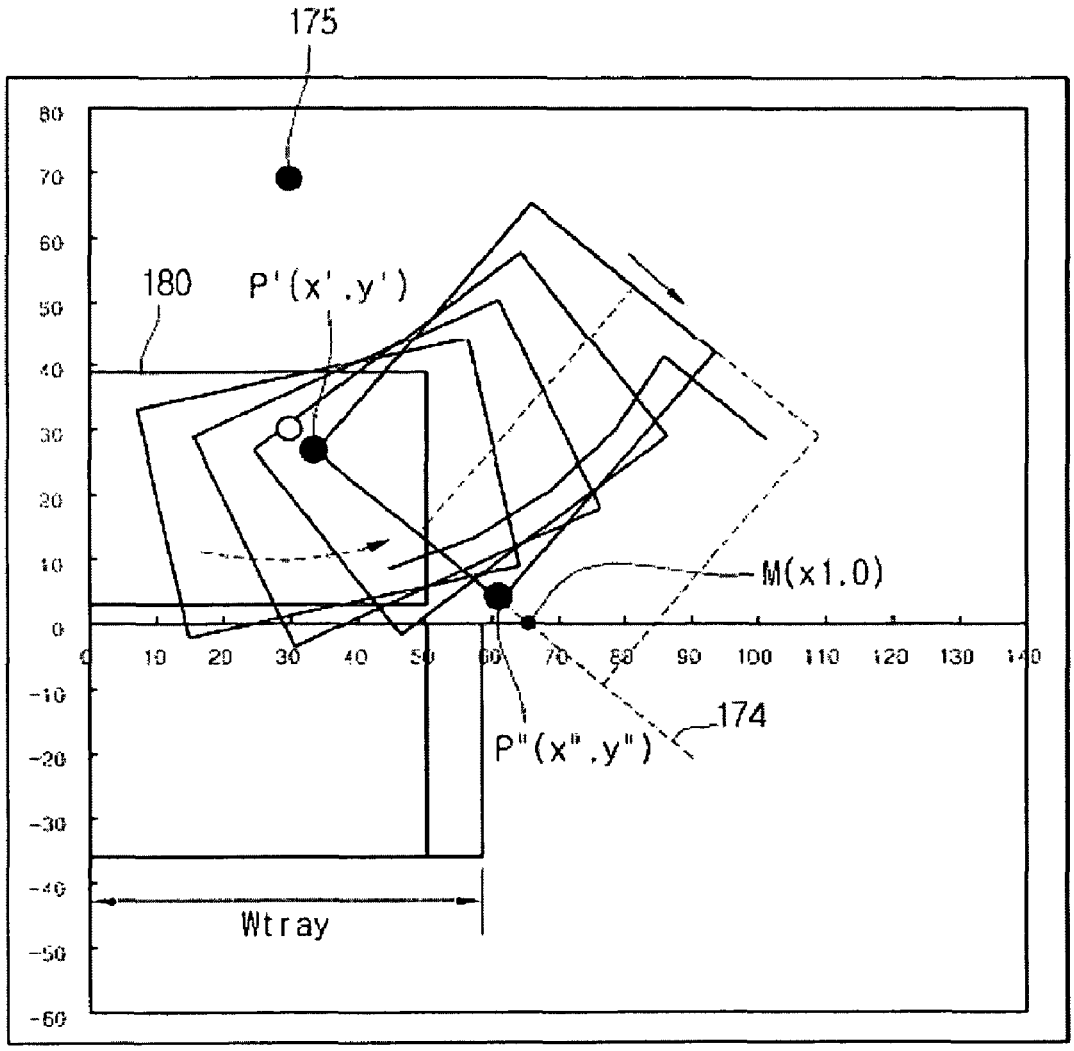
FIG. 8 is a schematic view illustrating a relationship between ice and an ice tray during the rotation of ice according to an embodiment of the present invention.

FIGS. 7A, 7B and 7C are schematic views illustrating rotation of an ice core making structure according to an embodiment of the present invention, and FIG. 8 is a schematic view illustrating a relationship between ice and an ice tray during the rotation of ice according to an embodiment of the present invention.

The following will describe a process for moving ice cubes made by the freezing cores 143 in a predetermined direction after the freezing cores 143 move and rotate with reference to FIGS. 7A through 7C.

First, when the cool air is supplied to the freezing cores 143 in a state where each of the freezing cores 143 is at least partially received in the ice making space 146*a* of the ice tray 146, the ice is formed in the ice making space 146*a* by heat transfer through the heat transferring fin 147.

After the above, when it is determined that there is a need to separate the ice from the ice tray 146, the heater of the ice tray 146 operates to apply heat to the ice tray 146 and thus the ice is separated from the ice tray 146.

When the driving motor 151 operates and the power of the driving motor 151 is transferred to the shafts 162 and 163 by the cam unit 152, the first and second shafts 162 and 163 ascend in the vertical direction. As a result, the guide unit 160 moves upward and the freezing cores 143 and the heat transferring fins 147 likewise move upward as they are guided by the guide unit 160.

In FIG. 7B, Δh indicates a distance which the freezing core 143 is raised above the upper side of the ice tray 146 and Wtray denotes a distance from a sidewall of the ice to a sidewall of the ice tray 146. Needless to say, it will be necessary for the ice to be raised higher than the uppermost end of the ice tray 146. This desired height will be substantially equal to or greater than the height Δh.

In addition, the ice is formed to extend from an inner bottom surface 172 of the ice-making space 146*a* by a predetermined height. It is preferable that an outer uppermost end 171 of the ice tray 146 is a starting point 173 of a coordinate system for calculating a vertical movement and rotational angle of the freezing cores 143.

A rotational center $(x_c,y_c)$ (175) of the freezing cores 143 is formed on the seating portion 164 through which the freezing cores 143 pass. After the freezing cores 143 move vertically, the freezing cores 143 may rotate by a predetermined rotational angle α in response to the interaction between the cam unit 152 and the shafts 162 and 163. After the freezing cores 143 are rotated, the ice separation heater 145 is operated, and heat is applied to the freezing cores 143. The ice cubes are then separated from the freezing cores 143 and fall down along a moving path 174. Here, the moving path 174 may follow a direction that is not concerned with an outer shape of the ice tray 146.

In order to prevent the falling ice cubes from interfering with the ice tray 146, there must be a predetermined clearance distance between the moving path 174 of the ice formed at the freezing cores 143 and the upper end of the ice tray 146. The clearance distance may be determined by a vertical ascending distance and rotating angle of the ice. This will enable the ice cubes to fall into a desired ice bank for dispensing.

The following will describe the process for the ascention of the ice 180 by Δh and the rotation of the ice 180 by the rotational angle α about the rotational center $(x_c,y_c)$.

When a point P(x,y) is translated toward the rotational center $(x_c,y_c)$, a new point $P_1(x_1,y_1)$ is attained. This can be expressed by $x=x-x_c$, $y_1=y-y_c$. A point $P_2(x_2,y_2)$ obtained by rotating the point $P_1(X_1, Y)$ by the rotational angle satisfies the following matrix equation (1).

$$x_2=\cos\alpha\cdot x_1-\sin\alpha\cdot y_1,\ y_2=\sin\alpha x_1+\cos\alpha\cdot y_1 \quad (1)$$

A point $P_r(x_r,y_r)$ is obtained by translating the point P(x,y) away from the rotational center $(x_c,y_c)$. Here, the following equation is obtained.

$$x_r=x_2+x_c,\ y_r=y_2+y_c \quad (2)$$

By the equations (1) and (2), the following equations (3) and (4) are attained.

$$X_r=(x-x_c)\cdot\cos\alpha-(y-y_c)\cdot\sin\alpha+x_c, \quad (3)$$

$$Y_y=(x-x_c)\cdot\sin\alpha+(y-y_c)\cdot\cos\alpha+y_c \quad (4)$$

The point $P_r(x_r,y_r)$ corresponds to a coordinate obtained by rotating a point P(x,y) of the ice.

Next, considering the upward movement of the ice, x=0 and y=Δh are applied to the point $Pr(x_r,y_r)$. Then, the coordinate of a point P'(x',y') that is obtained when the ice moves upward and rotates can be expressed by the following equations (5) and (6).

$$x'=(0-xc)\cdot\cos\alpha-(\Delta h-yc)\cdot\sin\alpha+xc, =-xc\cdot\cos\alpha-(\Delta h-yc)\cdot\sin\alpha+xc \quad (5)$$

$$y'=(0-xc)\cdot\sin\alpha+(\Delta h-y_c)\cdot\cos\alpha+y_c=-x_c\cdot\sin\alpha+(\Delta h-y_c)\cdot\cos\alpha+y_c \quad (6)$$

The coordinate P"(x",y") on a line extending from the coordinate P'(x',y') along the moving path 174 can be expressed by the following equations (7) and (8).

$$x''=(0-x_c)\cdot\cos\alpha-(\Delta h-h_{tray}-y_c)\cdot\sin\alpha+x_c, =-x_c\cdot\cos\alpha-(\Delta h-h_{tray}-y_c)\cdot\sin\alpha+x_c \quad (7)$$

$$y''=(0-x_c)\cdot\sin\alpha+(\Delta h-h_{tray}-y_c)\cdot\cos\alpha+y_c=-x_c\cdot\sin\alpha+(\Delta h-h_{tray}-y_c)\cdot\cos\alpha+y_c \quad (8)$$

In the above equations, $h_{tray}$ is a value extending along the moving path in a state where the ice moves upward and rotates.

An equation (9) of a line passing through the points P' and P" can be expressed as follows:

$$y-y'=-\cot\alpha(x-x') \quad (9)$$

Further, an intersecting point between the line passing through the points P' and P", i.e., ice movement path, and an X-axis must be greater than the width of the ice. More specifically a coordinate $M(x_1,0)$, defining the point where the ice movement path 174 meets the X-axis, must be greater than the X-axis coordinate point of the ice tray 146. Based on this, the following equations (10), (11), (12) and (13) are satisfied from equation (9) above.

$$0-y'=-\cot\alpha(x-x') \quad (10)$$

$$x=y'\tan\alpha+x'>W_{tray} \quad (11)$$

$$\tan\alpha>(W_{tray}-x')/y' \quad (12)$$

$$\tan\alpha>\frac{W\text{tray}+Xc*\cos\alpha+(\Delta h-Yc)*\sin\alpha-Xc}{-Xc*\sin\alpha+(\Delta h-Yc)*\cos\alpha+Yc} \quad (13)$$

When the vertical ascending distance and rotational angle of the ice are set considering the relationship between the width of the tray ($W_{tray}$), vertical ascending distance of the ice (Δh), and rotational center $(x_c,y_c)$ of the ice tray 146, the ice falls down along the moving path 174 and does not interfere with the ice tray 146. Needless to say, the vertical moving distance and rotational angle of the ice may be controlled by the driving motor 151 and the cam unit 152. A width and height of the ice tray 146 for preventing the ice from interfering with the ice tray 146 may be pre-set.

The following describes a second exemplary embodiment. The second exemplary embodiment relates to a structure where the ice tray 146, rather than the freezing cores 143 and the ice, moves in the vertical direction and then rotates. The second embodiment is substantially the same as the first embodiment except that the ice tray is axially connected to the motor 151 and the cam unit 152. Therefore, the main differences will be described for the second embodiment and like reference numbers will be used to refer to like parts.

Figure 9:
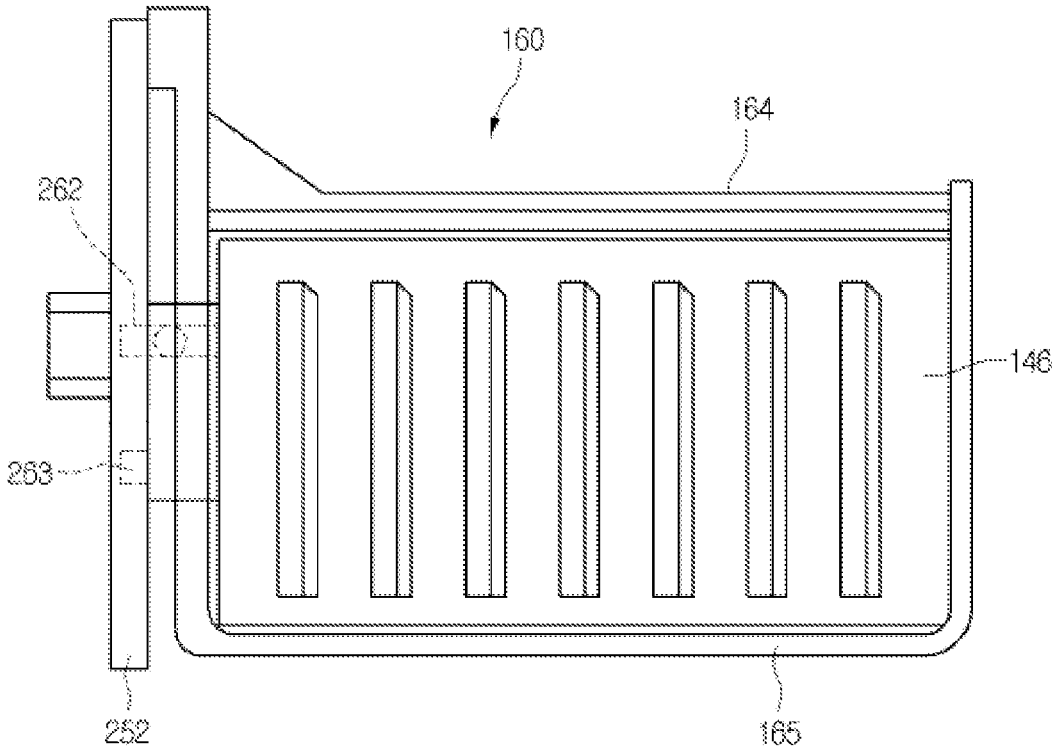
FIG. 9 is a perspective view of an ice-making device according to a second embodiment.

FIG. 9 is a perspective view of an ice-making device according to the second exemplary embodiment. Referring to FIG. 9, an ice-making device 140 in accordance with the second embodiment includes an ice tray 146 that is capable of vertically moving upward or downward and rotating in a predetermined direction.

In more detail, first and second shafts 262 and 263 are provided at a side of the ice tray 146 to vertically move and rotate the ice tray 146. The first and second shafts 262 and 263 extend from a side surface of the ice tray 146 toward an outer side. The first and second shafts 262 and 263 are inserted in the grooves of the cam unit 252 shown in FIG. 6. The first and second shafts 262 and 263 vertically move and rotate by being guided by cam 252 unit synchronizing with the motor 151. That is, the ice tray 146 vertically moves downward and subsequently rotates counterclockwise at a point where the ice is separated. The ice separated from the freezing cores 143 falls down by being guided by a side surface of the ice tray 146.

Meanwhile, as described with reference to FIGS. 7*a* through 8, the movement path of the ice is designed such that the ice does not interfere with the ice tray 146 when the ice is released into the ice bank. The mathematical relationship will be described hereinafter.

It is regarded that an upper end of ice tray 146 is a starting point 273 of a coordinate system. A point $P_1(W_t, -\Delta h)$ is a location attained by vertically moving the ice tray 146 downward ($W_t$ represents the width of the ice tray 146 and $P_1$ denotes an upper end of another side surface of the ice tray 146).

In this state, the ice tray 146 can be moved toward the rotational center $(x_c,y_c)$ and rotated by a rotational angle α. The ice tray 146 is then moved away from the rotational center $(x_c,y_c)$, i.e., returned to an initial position to determine a coordinate of $P_2(x_2,y_2)$.

At P2$(x_2,y_2)$, a coordinate value $x_2$ on the X-axis may be less than half the width of the ice. That is, when the ice tray rotates, an X-axis value of the upper end of another side surface may be formed at a further left side than the half of the width of the ice, i.e., a center of the ice.

The ice may be separated from the ice tray 146 in a state where it is spaced apart from a side of the ice tray 146. In this case, the ice does not fall back into the ice tray 146, but instead falls down into the ice bank while being guided along an outer surface of the ice tray 146. Accordingly, the ice can reliably fall down into the ice bank without interfering with the ice tray 146.

According to the exemplary embodiments, the freezing cores or the ice tray can moved vertically and rotated in accordance with the cam unit and the plurality of the shafts. Thus the ice can effectively be emptied from the ice making unit. Accordingly, the ice separating structure can be easily implemented. Further, the ice separated from the ice core can fall down into the ice bank without interfering with the ice tray by optimally designing the moving distance and rotational angle of the freezing core or the ice tray.

Although exemplary embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice-making device for a refrigerator, comprising:

a fixed ice tray defining an ice-making space and fixed within a storage chamber of refrigerator;

an ice core member that is at least partially received in the ice-making space;

a seating portion provided at an upper side of the ice tray, the seating portion having an insertion portion in which the ice core member is inserted;

a rotational center formed on the seating portion and defining a center for rotating of the ice core member;

a drive unit adapted to move the ice core member; and a power transmission unit adapted to transfer power from the driving unit to the ice core member and to control movements thereof, the power transmission unit comprises:

a cam unit adapted to transfer the power of the driving unit to the ice core member; and at least one shaft that communicates to the cam unit and guides the movements of the ice core member in accordance with a directional path defined by the cam unit, the movements including a first movement that the ice core member ascends above the ice tray and a second movement that the ice core member rotates on the rotational center after the first movement, wherein the ice core member is spaced apart from an upper end of the ice tray and disposed diagonally when the second movement completes, ice formed on the ice core member is separated from the ice core member after the ice is rotated on the rotational center so that the ice may fall downward into an ice bank without interference with upper end of the ice tray.

2. The ice-making device according to claim 1, further comprising a plurality of heat transferring fins through which the ice core member is inserted.

3. The ice-making device according to claim 2, wherein at least one of the heat transferring fins functions as an ice separation heater adapted to separate the ice from the ice core member.

4. The ice-making device according to claim 1, wherein the ice follows an ice separation path as it travels to the ice bank, and wherein the ice separation path does not interfere with an outer edge of the ice tray.

5. The ice-making device according to claim 1, wherein a lower end portion of the ice making space is at least partly rounded.

6. The ice-making device according to claim 2, wherein the heat transferring fin is seated on the seating portion.

7. The ice-making device according to claim 1, further comprising a tilt prevention portion that prevents the seating portion from tilting downward when the ice core member moves.

8. The ice-making device according to claim 1, wherein a lower end of the ice core member rises above the ice tray when the shaft completes upward movement.

9. The ice-making device according to claim 1, wherein the ice core member does not interfere with a side of the ice tray when the shaft member performs the second movement.

* * * * *